United States Patent [19]

Astill

[11] Patent Number: 4,609,111

[45] Date of Patent: Sep. 2, 1986

[54] ROTATABLE STAND

[76] Inventor: Maurice J. Astill, Barkes Corner, Pyes Pa Road, Tauranga, New Zealand

[21] Appl. No.: 597,356

[22] Filed: Apr. 6, 1984

[51] Int. Cl.[4] ..... A47F 3/08

[52] U.S. Cl. ..... 211/1.5; 104/44

[58] Field of Search ..... 211/1.5; 104/44; 211/23, 24; 269/58

[56] References Cited

U.S. PATENT DOCUMENTS

| | | | |
|---|---|---|---|
| 936,854 | 10/1909 | Beattie | 104/44 |
| 1,080,384 | 12/1913 | McElmer Stewart | 104/44 |
| 1,083,609 | 1/1914 | Grammes | 104/44 |
| 1,237,022 | 8/1917 | Craig | 104/44 |
| 1,401,379 | 12/1921 | Vechten | 211/1.5 X |
| 1,596,156 | 8/1926 | Craig | 211/1.5 X |
| 1,625,326 | 4/1927 | Marx | 211/1.5 X |
| 3,017,150 | 1/1962 | Kahle | 211/1.5 X |

FOREIGN PATENT DOCUMENTS

| | | | |
|---|---|---|---|
| 1434336 | 5/1976 | United Kingdom | 104/44 |

*Primary Examiner*—J. Franklin Foss
*Assistant Examiner*—Sarah Lechok Eley
*Attorney, Agent, or Firm*—Abelman Frayne Rezac & Schwab

[57] ABSTRACT

The present invention provides a rotatable stand usable for displaying objects such as motor vehicles. The rotatable stand has a central rotatable member rotatable on a base and the rotatable member supports extensible limbs on which objects for display can be supported.

1 Claim, 3 Drawing Figures

ROTATABLE STAND

This invention relates to rotatable stands.

It is an object of the present invention to provide a rotatable stand which can be used for turning a variety of diverse shaped objects for display and other purposes.

Further objects and advantages of the present invention will become apparent from the ensuing description which is given by way of example.

According to the present invention there is provided a rotatable stand comprising a base, a rotatable member pivotally mounted on said base, and a plurality of extensible limbs extending from said rotatable member having platforms for supporting an article or articles, the arrangement being such that the rotatable stand can be used to support and rotate a variety of diverse shaped objects with said extensible limbs providing support therefor.

Figure 1:
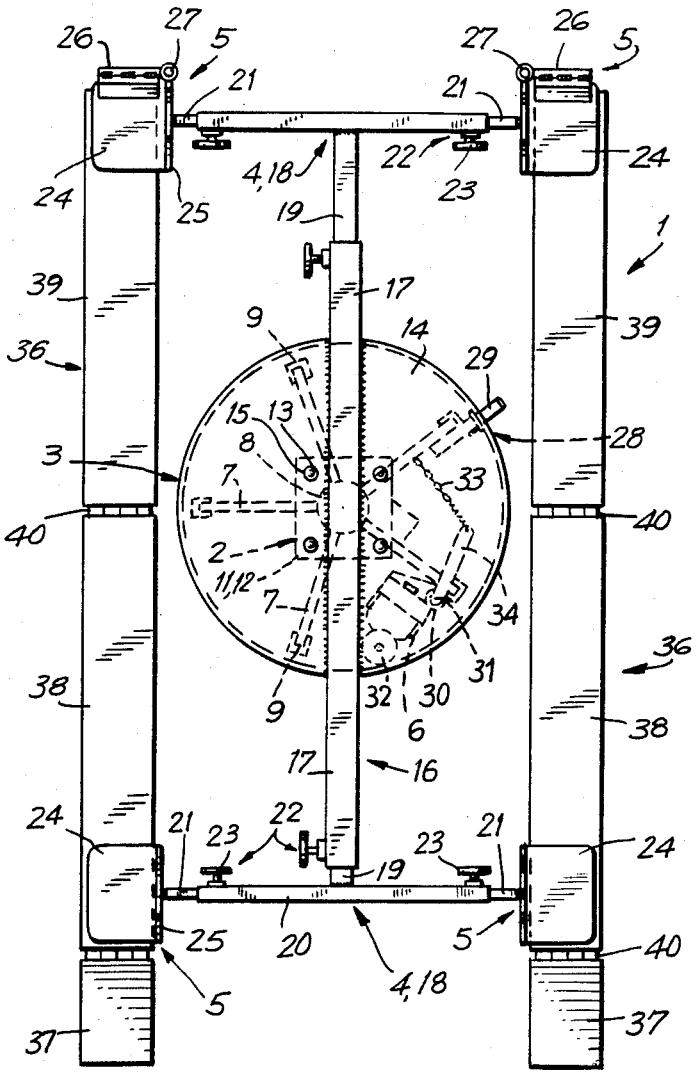
Figure 2:
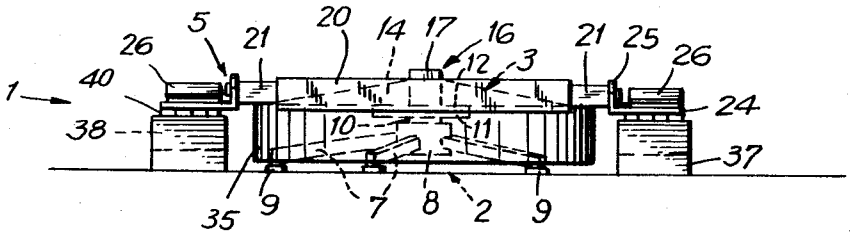
Figure 3:
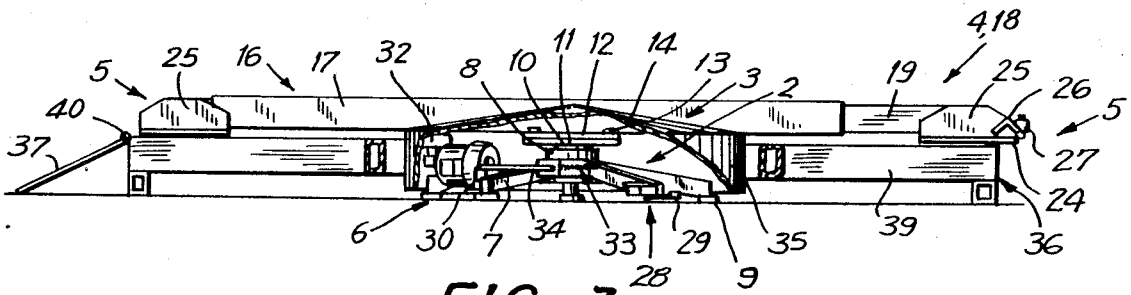

Aspects of the present invention will now be described by way of example only with reference to the accompanying drawings in which:

FIG. 1: is a top view of a rotatable stand in accordance with one possible embodiment of the present invention, and FIG. 2: is a side view of the rotatable stand shown in FIG. 1, and FIG. 3: is a side and part-cross-section of a rotatable stand as shown in FIGS. 1 and 2.

With reference to the drawings and in accordance with the example illustrated a rotatable stand generally indicated by arrow 1 comprises a base generally indicated by arrow 2, a rotatable member generally indicated by arrow 3 pivotally mounted on said base 2, and a plurality of extensible limbs generally indicated by arrow 4 extending from said rotatable member 3 having platforms generally indicated by arrow 5 for supporting an article or articles (not shown) the arrangement being such that the rotatable stand 1 can be used to support and rotate a variety of diverse shaped objects with said extensible limbs providing support therefor.

The rotatable stand 1 may be caused to rotate by a prime mover generally indicated by arrow 6 which can be fixed to the base 2.

The base 2 comprises a plurality of legs 7 which can extend radially out from a centre 8 of said base and include feet 9 for added stability.

The rotatable member 3 is pivotally mounted on the base 2 by means of a centrally located axle 10 which is journalled in bearings (not shown). Alternatively the rotatable member 3 can be pivotally mounted by means of a pivot member (not shown) located at the centre 8 of the base.

A mounting plate 11 surmounts the axle 10, said mounting plate 11 being secured to a second plate 12 which is located to the undersurface of the rotatable member 3, the arrangement being such that the mounting plate 11 and second plate 12 can be fixed together by means of mounting bolts 13 thus securing the rotatable member 3 to the base 2.

The rotatable member 3 comprises a hub 14 which includes apertures 15 located above the bolts 13 such that ready access to said bolts is permitted.

The hub 14 of the rotatable member incorporates a mounting means generally indicated by arrow 16 for mounting the extensible limbs 4, said mounting means 16 comprising a main beam 17 supported from the rotatable member 3.

The main beam 17 and the extensible limbs 4 are fabricated in steel tube section.

The main beam 17 and the extensible limbs 4 are constructed in square tube sections. Alternatively, tube sections of a different shape can be used where their shape or by means of a securing device (not shown) prevent the twisting of tube sections of different dimensions which are placed in or over the ends of other compatably shaped tube sections.

The extensible limbs 4 comprise a main beam extension member generally indicated by arrow 18, said main beam extension member comprising a first section 19 extensibly supported from the mounting means 16 and a second section 20 mounted to the first section in a crosswise position.

A main beam extension member 18 is fabricated in tube section of symmetrical though lesser proportions to the main beam 17 such that a main beam extension member 18 can be slidably mounted into either open end of the main beam 17, the arrangement being such that the stand is extensible lengthwise. Alternatively, where the main beam extension member 18 is fabricated in a tube section of a larger dimension, the main beam extension member 18 can be mounted in a slidable fit over the main beam 17.

The second section 20 supports extensible arms 21 which are slidably mounted into and/or over either open end of the second section in the same way as described above with respect to the slidable mounting of the first section 19 to the main beam 17, the arrangement being such that the stand is provided with widthwise extensibility.

A locking means generally indicated by arrow 22 is provided so as to fix the extensible limbs 4 at the desired degree of extension. Said locking means 22 comprises a threaded locking bolt 23 located in outer tube sections close to the open ends of the main beam 17 and second section 20 such that when said locking bolts 23 are screwed through the outer tube sections contact is made with the extensible limb or slidable tube within and further movement thereof is restricted.

Alternatively, the locking means 23 can comprise any other mechanism capable of securing an extensible inner tube section in relation to an outer tube section so as to prevent further movement.

The extensible limbs 4 incorporate marked measurements (not shown) to aid in effecting precise adjustments in the extension of the stand.

In another embodiment of the main beam extension member 18 (which is not shown in the drawings), the second section 20 comprises extensible arms pivotally mounted to a first section 19, the arrangement being such that said extensible arms can be positioned at a variety of angles in relation to the main beam 17 or first section 19 and thus a further dimension to the adaptability of this stand to accommodate diverse shaped objects is provided.

Platforms 5 for supporting articles are mounted to the extensible arms 21, said platforms comprising a base 24 and a side member 25 which can abut the end of the extensible arm 21. The platforms 5 mount chocks 26 which can be positioned so as to prevent an object once placed on the platform from moving out of position. There can be more than one chock on each platform.

The chocks 26 are pivotally mounted to the platforms by means of hinges 27 fixed to either the side 25 or the base 24 of said platform 5.

A braking means generally indicated by arrow 28 is provided such that when actuated the rotatable member 3, and thus the stand 1, is prevented from rotating and consequently the stand 1 is more easily loaded.

The braking means 28 is mounted to one leg 7 of the base 2 being positioned so that an actuating lever 29 extends clear of the hub 14 so as to be accessible, operation of which causes a brake shoe (not shown) or the like, to engage the rotatable member 3 and thus prevent further rotation.

The rotatable stand is driven by a prime mover which in the preferred embodiment shown in the drawings comprises an electric motor.

The prime mover 6 is pivotally mounted on a support member 30 to a leg 7 of the base by means of a hinge 31. The prime mover 6 can power a drive wheel 32 which is held in contact with the rotatable member 3 so as to rotate same on its axis. Contact between the drive wheel 32 and the rotatable member 3 is maintained by means of a biasing means such as a spring generally indicated by arrow 33, which co-acts with a lever 34 connecting the pivotally mounted prime mover 6 so that the drive wheel 32 is constantly held against the rotatable member.

The hub 14 of the rotatable member 3 incorporates a rim depending downwardly from the periphery of said hub such that the drive wheel 32 engages the inside surface of the rim and thus rotates the rotatable member.

The drive wheel 32 is disengagable from its contact with the rotatable member 3 by removing the force exerted by the biasing means 33 on the lever 34, which is effected by detatching said biasing means 33 from the lever 34. Alternatively a lever (not shown) can be used which pivots the prime mover 6 away from its contact with the rotatable member.

Platform loading aids generally indicated by arrow 36 can be used in association with the rotatable stand 1 and comprises a ramp plate 37 pivotally mounted to a raised surface 38 which in turn is pivotally mounted to a further raised surface 39, the arrangement being such that the said loading aids 36 which are designed to fit closely under the platforms 5 facilitate the loading of the stand 1 and aid in stabilizing the stand if weight is unevenly placed on one platform without counterbalancing on another platform. The various pivots 40 along the length of the loading aids 36 make the loading aids easier to store.

Aspects of the present invention have been described by way of example only and it will be appreciated that modifications and additions thereto may be made without departing from the scope thereof as defined in the appended claims.

I claim:

1. A rotatable stand comprising:

a static base;

a rotatable hub pivotally mounted on said base, said hub having a vertical axis;

a main beam supported horizontally on the hub and extending diametrically thereof;

two pairs of extensible limbs extending from said main beam to form an H-configuration, each limb having a supported end connected to the spine beam and a free end;

a wheel supporting platform carried at the free end of each limb;

drive means for rotating the hub;

brake means for arresting the hub;

the two platforms of one pair of limbs having a leading edge lying transversely to the longitudinal direction and a wheel-arresting chock associated with each of the two platforms arranged to pivot between the wheel arresting position parallel to the leading edge and a non-arresting position clear of the leading edge;

each said wheel arresting chock being pivoted at one of its ends for movement about an axis perpendicular to the associated said platform, said axis being parallel to the vertical axis of the hub; and, removable platform loading aids positioned beneath respective pairs of platforms at opposite sides respective pairs of platforms at opposite sides of said main beam and acting to stabilize said stand during the loading thereof.

* * * * *